US006185770B1

(12) United States Patent
Wang

(10) Patent No.: US 6,185,770 B1
(45) Date of Patent: Feb. 13, 2001

(54) AIR MATTRESS

(75) Inventor: Cheng-Chung Wang, Taipei (TW)

(73) Assignee: Team Worldwide Corporation, Taipei (TW)

( * ) Notice: Under 35 U.S.C. 154(b), the term of this patent shall be extended for 0 days.

(21) Appl. No.: 09/456,533

(22) Filed: Dec. 8, 1999

(51) Int. Cl.[7] ..... A47C 27/08
(52) U.S. Cl. ..... 5/706; 5/686; 5/932; 5/708
(58) Field of Search ..... 5/706, 686, 932, 5/665, 708

(56) References Cited

U.S. PATENT DOCUMENTS 4,365,370 * 12/1982 Larson ..... 5/686
6,076,214 * 6/2000 Klimenko ..... 5/706

* cited by examiner

*Primary Examiner*—Alexander Grosz
(74) *Attorney, Agent, or Firm*—Millen, White, Zelano & Branigan, P.C.

(57) ABSTRACT

An air mattress includes an upper sheet with a tufted top surface, a lower sheet, and front and rear sheets. The front sheet has upper, lower and lateral edges. The upper edge of the front sheet is sealed to a front edge of the upper sheet, is longer than the front edge of the upper sheet, and has excess portions on two sides of the front edge of the upper sheet. The rear sheet has upper edge, lower and lateral edges. The upper edge of the rear sheet is sealed to a rear edge of the upper sheet, is longer than the rear edge of the upper sheet, and has excess portions on two sides of the rear edge of the upper sheet. The lower sheet has a front edge sealed to the lower edge, the lateral edges, and the excess portions of the upper edge of the front sheet. The lower sheet has a rear edge sealed to the lower edge, the lateral edges, and the excess portions of the upper edge of the rear sheet. The lower sheet further has lateral edges sealed to lateral edges of the upper sheet. An air receiving space is confined by the upper, lower, front and rear sheets.

10 Claims, 5 Drawing Sheets

AIR MATTRESS

BACKGROUND OF THE INVENTION

1. Field of the Invention

The invention relates to an air mattress, more particularly to an air mattress which can be manufactured at a reduced cost.

2. Description of the Related Art

FIG. 1 illustrates a conventional air mattress 1 which includes an upper sheet 11, a lower sheet 13, and a surrounding sheet 12 interconnecting the upper and lower sheets 11, 13. An upper edge 121 of the surrounding sheet 12 is sealed to four sides of the upper sheet 11. A lower edge 122 of the surrounding sheet 12 is sealed to four sides of the lower sheet 13. The upper sheet 11 has a top surface adapted to be in contact with the body of a user. To provide a comfortable feeling of touch, the top surface of the upper sheet 11 is pre-treated, such as by printing, by attaching with fabrics or by planting tufts thereon. However, a pre-treated plastic sheet, such as a tufted plastic sheet, has a significantly higher cost of material than a non-treated plastic sheet. In the conventional air mattress 1, the upper sheet 11 has a size generally identical to that of the lower sheet 13. The cost of material for manufacturing the air mattress 1 is relatively high.

SUMMARY OF THE INVENTION

Therefore, the main object of the present invention is to provide an air mattress which can be manufactured at a lower material cost.

Accordingly, the air mattress of the present invention includes an inflatable main body which has an upper sheet, a lower sheet, and front and rear sheets. The upper sheet is made of a heat-sealable plastic material, and has front and rear edges and opposite lateral edges. The upper sheet further has a tufted top surface. The front sheet is made of a heat-sealable plastic material, and has an upper edge which is sealed to the front edge of the upper sheet, a lower edge, and opposite lateral edges interconnecting the upper and lower edges. The upper edge of the front sheet is longer than the front edge of the upper sheet, and has excess portions on two sides of the front edge of the upper sheet. The rear sheet is made of a heat-sealable plastic material, and has an upper edge which is sealed to the rear edge of the upper sheet, a lower edge and opposite lateral edges which interconnect the upper and lower edges of the rear sheet. The upper edge of the rear sheet is longer than the rear edge of the upper sheet, and has excess portions on two sides of the rear edge of the upper sheet. The lower sheet is made of a heat-sealable plastic material, and has a front edge, a rear edge and two opposite lateral edges interconnecting the front and rear edges of the lower sheet. The front edge of the lower sheet is sealed to the lower edge, the lateral edges, and the excess portions of the upper edge of the front sheet. The rear edge of the lower sheet is sealed to the lower edge, the lateral edges, and the excess portions of the upper edge of the rear sheet. The lateral edges of the lower sheet are sealed to the lateral edges of the upper sheet. An air receiving space is confined by the upper, lower, front and rear sheets.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
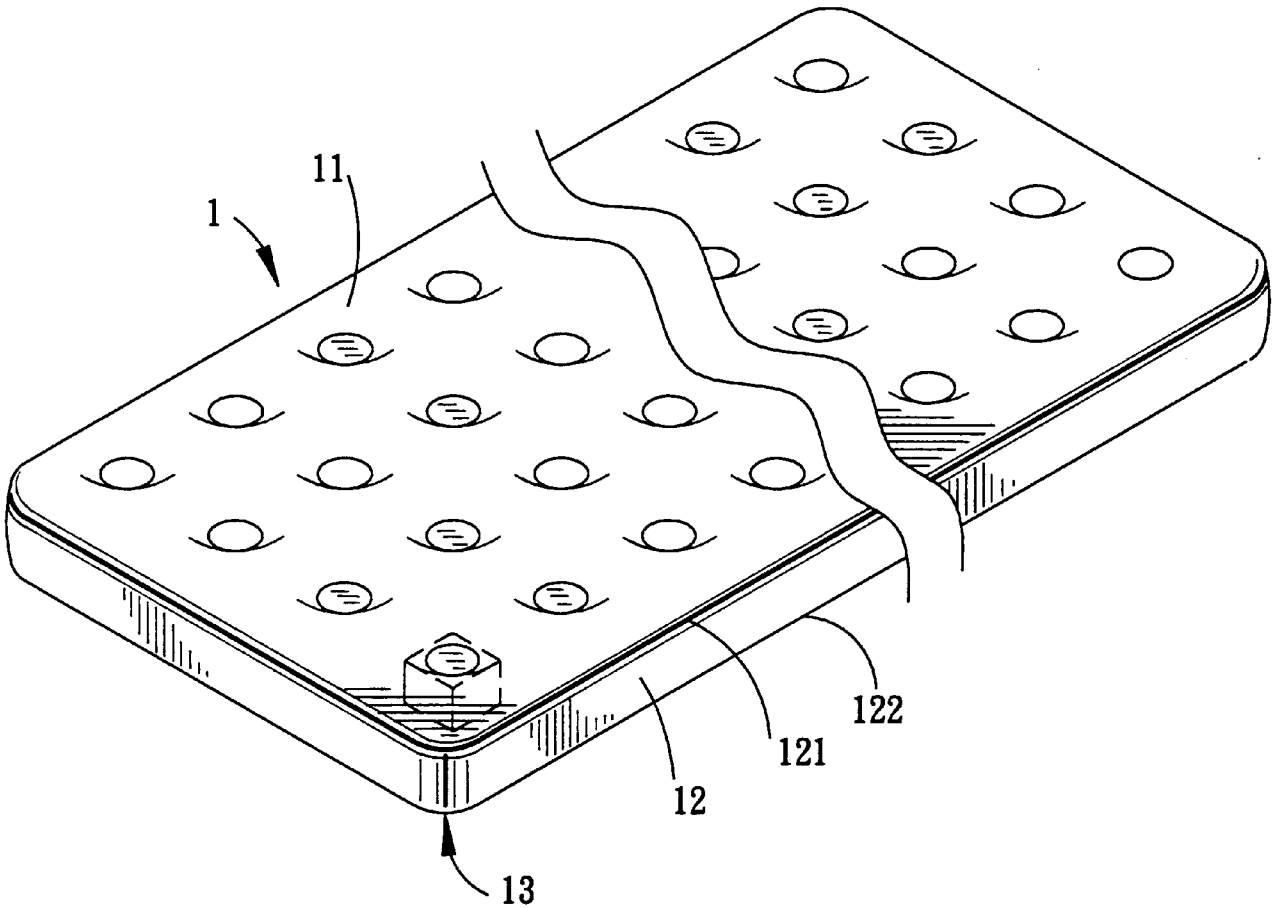
FIG. 1 PRIOR ART
FIG. 1 is a perspective view of a conventional air mattress.
Figure 2:
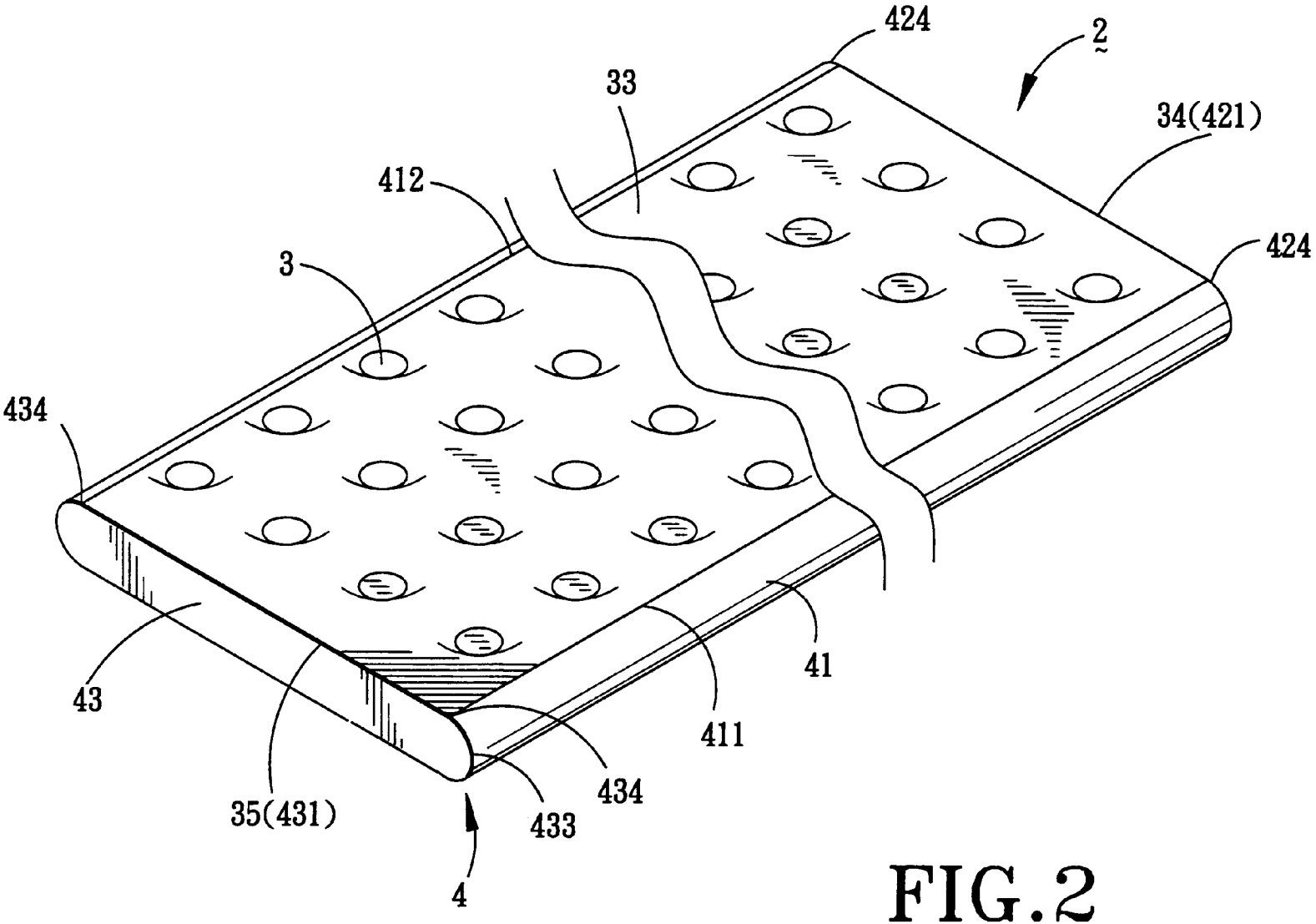
FIG. 2 is a perspective view of a preferred embodiment of the air mattress of the present invention.
Figure 3:
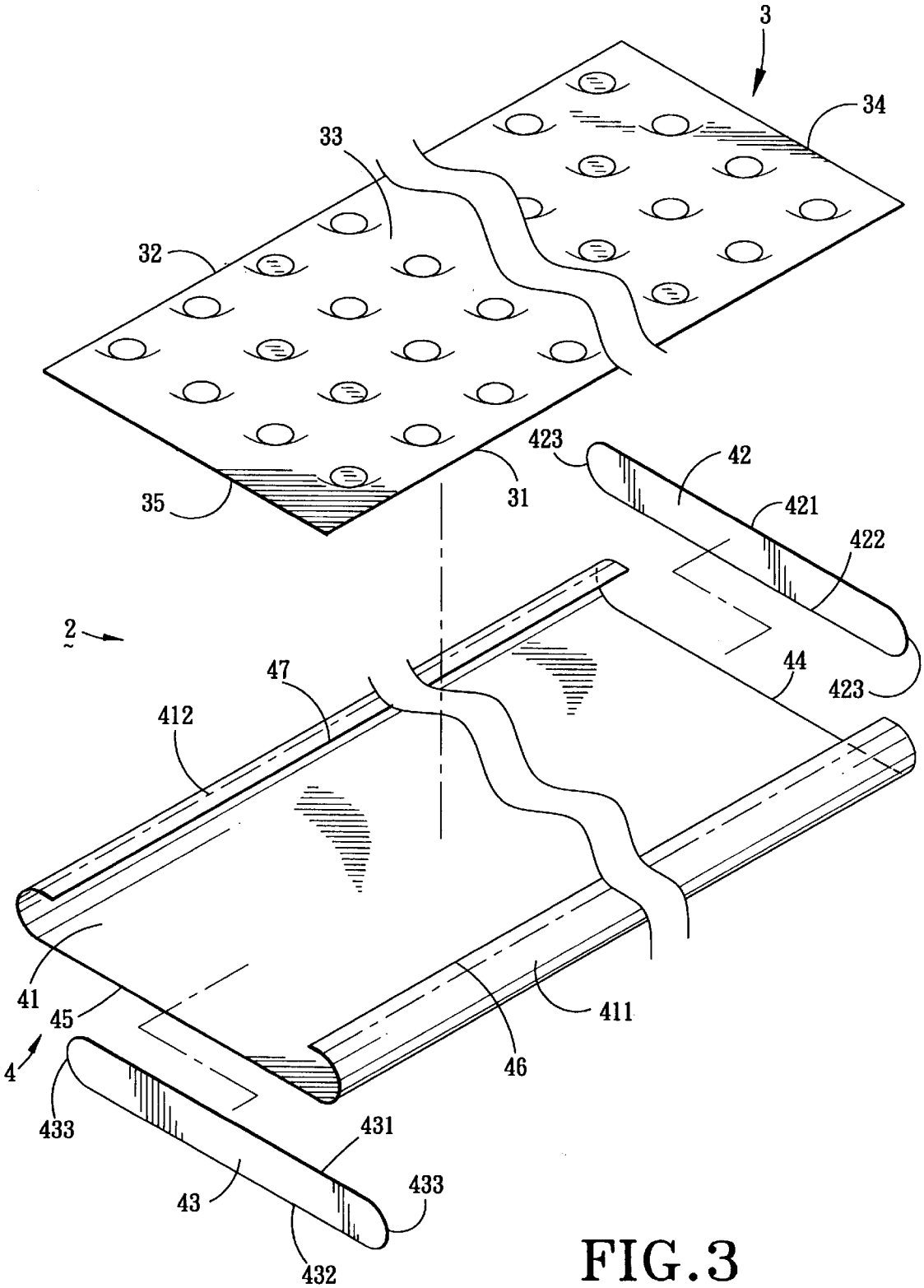
FIG. 3 is an exploded perspective view of the preferred embodiment.

Referring to FIGS. 2 and 3, the preferred embodiment of the air mattress of the present invention is shown to include an inflatable main body 2 which is composed of an upper sheet 3, a lower sheet 4, and front and rear sheets 42, 43.

The upper sheet 3 is made of a heat-sealable and flexible plastic material, and is rectangular in shape. The upper sheet 3 has a tufted top surface 33, a front edge 34, a rear edge 35, and opposite lateral edges 31, 32 interconnecting the front and rear edges 34, 35.

The front sheet 42 is made of a heat-sealable and flexible plastic material, and has an upper edge 421, a lower edge 422, and opposite lateral edges 423 interconnecting the upper and lower edges 421, 422. The upper edge 421 of the front sheet 42 is sealed to the front edge 34 of the upper sheet 3. The upper edge 421 of the front sheet 42 is longer than the front edge 34 of the upper sheet 3, and has two excess portions 424 on two sides of the front edge 34 of the upper sheet 3.

The rear sheet 43 is made of a heat-sealable and flexible plastic material, and has an upper edge 431, a lower edge 432, and opposite lateral edges 433 interconnecting the upper and lower edges 431, 432. The upper edge 431 of the rear sheet 43 is sealed to the rear edge 35 of the upper sheet 3. The upper edge 431 of the rear sheet 43 is longer than the rear edge 35 of the upper sheet 3, and has two excess portions 434 on two sides of the rear edge 35 of the upper sheet 3.

The lower sheet 4 is also made of a heat-sealable plastic material, and is formed as a one-piece body. The lower sheet 4 has a front edge 44, a rear edge 45, and two opposite lateral edges 46, 47 interconnecting the front and rear edges 44, 45 thereof. The lower sheet 4 has a bottom portion 41 disposed below the upper sheet 3, and two side portions 411, 412 which extend upwardly from the bottom portion 41 and which are formed with the lateral edges 46, 47, respectively. The front edge 44 of the lower sheet 4 is sealed to the lower edge 422, the lateral edges 423 and the excess portions 424 of the upper edge 421 of the front sheet 42. The rear edge 45 of the lower sheet 4 is sealed to the lower edge 432, the lateral edges 433 and the excess portions 434 of the upper edge 431 of the rear sheet 43. The lateral edges 46, 47 of the lower sheet 4 are sealed to the lateral edges 31, 32 of the upper sheet 3, respectively. An air receiving space is confined by the upper, lower, front and rear sheets 3, 4, 42, 43.

Since the side portions 411, 412 of the lower sheet 4 extend to a top side of the main body 2 of the air mattress, the size of the upper sheet 3 is smaller than the area of the entire top surface of the main body 2 of the air mattress. The cost of material for the tufted upper sheet 3 is reduced accordingly, thereby lowering the manufacturing cost.

Figure 4:
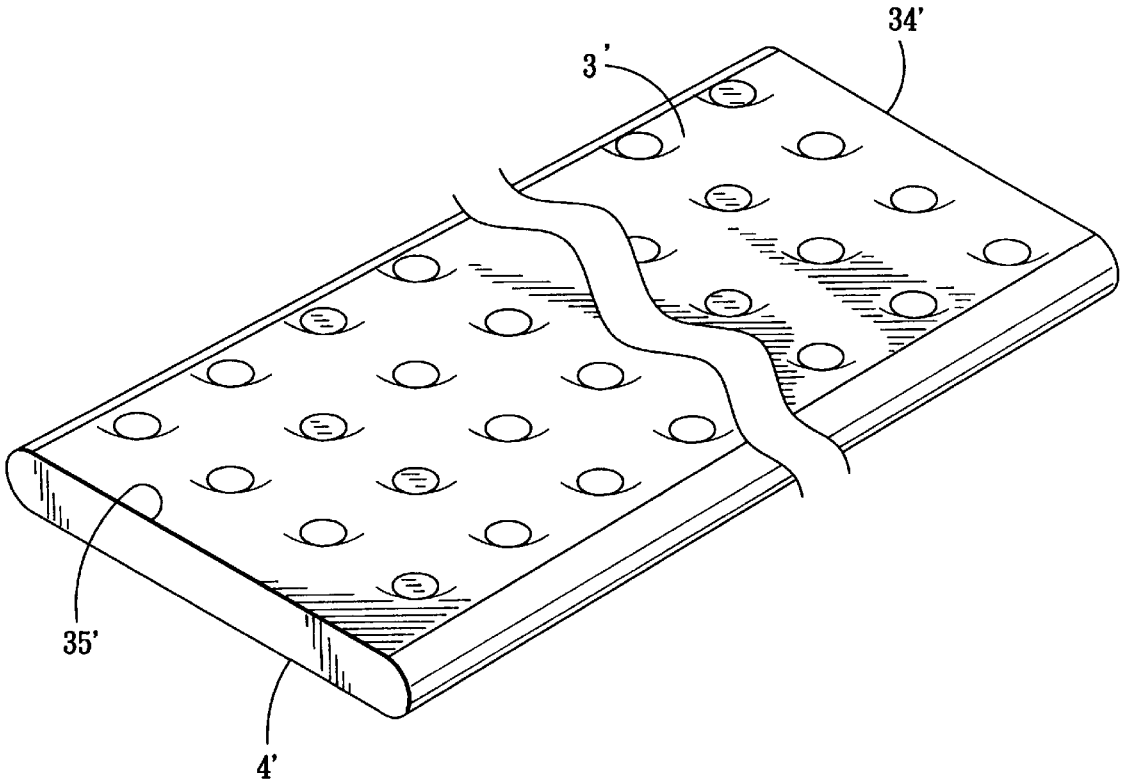
FIG. 4 is a perspective view of another preferred embodiment of the air mattress of the present invention.

Referring to FIG. 4, in a modified embodiment, each of the upper and lower sheets 3', 4' is trapezoid in shape. The front edge 34' of the upper sheet 3' is slightly shorter than the rear edge 35' of the upper sheet 3'. The size of the upper sheet 3' can be further reduced to result in added cost savings.

Figure 5:
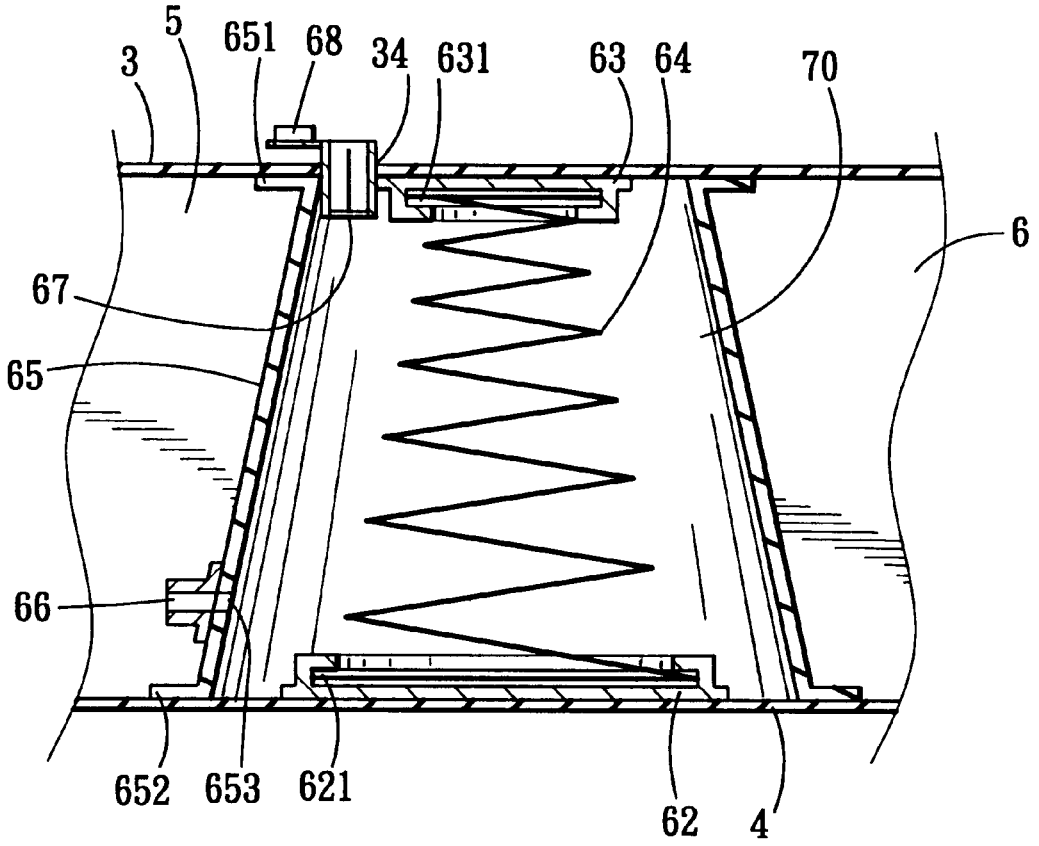
FIG. 5 is a fragmentary sectional view illustrating a pumping unit mounted in the preferred embodiment of the air mattress of the present invention.

Referring to FIG. 5, to facilitate inflation of the air mattress of the present invention, a pumping unit 6 may be provided in the main body 2 between the upper and lower sheets 3, 4. The pumping unit 6 includes an upper mounting seat 63 made of a rigid plastic and sealed to the upper sheet 3, a lower mounting seat 62 made of a rigid plastic and sealed to the lower sheet 4, a compression spring 64, such as a spiral spring, disposed between the upper and lower mounting seats 63, 62, and an annular surrounding wall 65 disposed around the compression spring 64 and the upper and lower mounting seats 63, 62. Each of the upper and lower mounting seats 63, 62 is formed with a retaining groove 631, 621 for retaining a respective one of upper and lower ends of the compression spring 64. The surrounding wall 65 is made of a heat-sealable plastic material, and has an upper edge 651 sealed to the upper sheet 3 of the main body 2, and a lower edge 652 sealed to the lower sheet 4 of the main body 2. The surrounding wall 65 cooperates with the upper and lower sheets 3, 4 of the main body 2 to confine an airtight pumping chamber 70. The upper sheet 3 has an air inlet 34 which is communicated with the pumping chamber 70 and which is provided with a first uni-directional valve member 67 and a plug 68 for closing the air inlet 34. The first uni-directional valve member 67 permits air to flow into the pumping chamber 70 via the air inlet 34, while preventing air to flow out of the pumping chamber 70 via the air inlet 34. The surrounding wall 65 is formed with an air passage hole 653 which communicates the pumping chamber 70 with the air receiving space 5 of the main body 2 and which is provided with a second uni-directional valve member 66 that permits air to flow out of the pumping chamber 70 via the air passage hole 653 while preventing air to flow into the pumping chamber 70 via the air passage hole 653.

The main body 2 of the air mattress can be inflated by stepping on the upper sheet 3 above the compression spring 64 to result in alternating compression and expansion of the compression spring 64 SO as to pump air into the air receiving space 5 via the air inlet 34, the pumping chamber 70 and the air passage hole 653. A venting valve (not shown) may be provided in the main body 2 to permit release of air therefrom to facilitate storage and transport of the air mattress.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An air mattress comprising:

an inflatable main body which includes an upper sheet made of a heat-sealable plastic material and having front and rear edges and opposite lateral edges, said upper sheet further having a tufted top surface;

a front sheet made of a heat-sealable plastic material, said front sheet having an upper edge which is sealed to said front edge of said upper sheet, a lower edge and opposite lateral edges interconnecting said upper and lower edges, said upper edge of said front sheet being longer than said front edge of said upper sheet and having excess portions on two sides of said front edge of said upper sheet;

a rear sheet made of a heat-sealable plastic material, said rear sheet having an upper edge which is sealed to said rear edge of said upper sheet, a lower edge and opposite lateral edges which interconnect said upper and lower edges of said rear sheet, said upper edge of said rear sheet being longer than said rear edge of said upper sheet and having excess portions on two sides of said rear edge of said upper sheet; and a lower sheet made of a heat-sealable plastic material, said lower sheet having a front edge, a rear edge and two opposite lateral edges interconnecting said front and rear edges of said lower sheet, said front edge of said lower sheet being sealed to said lower edge, said lateral edges, and said excess portions of said upper edge of said front sheet, said rear edge of said lower sheet being sealed to said lower edge, said lateral edges, and said excess portions of said upper edge of said rear sheet, said lateral edges of said lower sheet being sealed to said lateral edges of said upper sheet, wherein an air receiving space is confined by said upper, lower, front and rear sheets.

2. The air mattress according to claim 1, wherein said lower sheet of said main body is formed as a one-piece sheet.

3. The air mattress according to claim 1, wherein said front edge of said upper sheet is shorter than said rear edge of said upper sheet.

4. The air mattress according to claim 1, further comprising a pumping unit mounted on said main body, said pumping unit being operable for inflation of main body.

5. The air mattress according to claim 4, wherein said pumping unit is mounted between said upper and lower sheets of said main body, said pumping unit including a compression spring which has an upper end mounted on said upper sheet and a lower end mounted on said lower sheet, and an annular surrounding wall made of a heat-sealable plastic material and disposed around said compression spring, said surrounding wall finally cooperating with said upper and lower sheets to confine a pumping chamber, on one of said upper or lower sheet of said main body being provided an air inlet which is communicated with said pumping chamber and which is provided with a first uni-directional valve member that permits air to flow into said pumping chamber via said air inlet while preventing air to flow out of said pumping chamber via said air inlet, said surrounding wall being formed with an air passage hole which communicates said air receiving space with said pumping chamber and which is provided with a second unidirectional valve member that permits air to flow out of said pumping chamber via said air passage hole while preventing air to flow into said pumping chamber via said air passage hole.

6. The air mattress according to claim 5, wherein said pumping unit further includes an upper mounting seat made of a plastic and sealed to said upper sheet, and a lower mounting seat made of a plastic and connected to said lower sheet, each of said upper and lower mounting seats being formed for mounting said compression spring.

7. An air mattress comprising:

an inflatable body having a substantially flat top face, a substantially flat bottom face, a multi-sided lateral face interconnecting said top and bottom faces;

said inflatable body further including a heat-sealable plastic upper sheet, and a heat-sealable plastic lower sheet having an area greater than that said upper sheet, said upper sheet having a tufted top surface and defining a portion of said top face, said tufted top surface having an area smaller than that of said top face, said lower sheet defining an entire area of said bottom face.

8. The air mattress as claimed in claim 7, wherein said multi-sided lateral face has four sides, said upper and lower sheets are substantially rectangular, said lower sheet extending through said multi-sided lateral face to reach said top face and is heat-sealed to said upper sheet, thereby forming a heat-sealed seam which interconnects said lower and upper sheets on said top face.

9. The air mattress as claimed in claim 7 wherein the lower sheet extends over at least portions of said lateral face and over portions of said upper face not defined by said tufted top.

10. The air mattress as claimed in claim 9 wherein the portions of said external face are opposed sides of the mattress.

* * * * *